US008723008B1

(12) United States Patent
Darnell

(10) Patent No.: US 8,723,008 B1
(45) Date of Patent: May 13, 2014

(54) KICK STAND FOR SNARE DRUM

(71) Applicant: Dean James Darnell, Ellisville, MO (US)

(72) Inventor: Dean James Darnell, Ellisville, MO (US)

( * ) Notice: Subject to any disclaimer, the term of this patent is extended or adjusted under 35 U.S.C. 154(b) by 0 days.

(21) Appl. No.: 13/762,987

(22) Filed: Feb. 8, 2013

(51) Int. Cl.
*G10D 13/02* (2006.01)

(52) U.S. Cl.
CPC ..... *G10D 13/026* (2013.01)
USPC ..... 84/421

(58) Field of Classification Search
CPC ..... G10D 13/026
USPC ..... 84/421
See application file for complete search history.

(56) References Cited

U.S. PATENT DOCUMENTS 373,873 A * 11/1887 Wurlitzer ..... 84/421
516,612 A * 3/1894 Rappold ..... 84/422.2
1,022,149 A * 4/1912 Maphet ..... 84/421
1,604,670 A * 10/1926 Willis et al. ..... 84/422.1
1,630,701 A * 5/1927 Gladstone ..... 84/421
D295,053 S * 4/1988 Diaz ..... D17/22
4,829,874 A * 5/1989 Hoshino ..... 84/421
5,467,680 A 11/1995 Kurosaki
D396,008 S * 7/1998 Hay ..... D9/455
5,977,464 A * 11/1999 Bencomo, Jr. ..... 84/421
6,384,308 B1 5/2002 Hoshino
7,208,667 B2 * 4/2007 Morgan et al. ..... 84/421
7,576,275 B2 * 8/2009 Dixson, Jr. ..... 84/421

* cited by examiner

*Primary Examiner* — Robert W Horn
(74) *Attorney, Agent, or Firm* — Linda L. Lewis; CreatiVenture Law

(57) ABSTRACT

A snare drum kick stand having a base having at least one slot, with a front cradle is supported by front uprights fixably attached to the base, and a rear cradle supported by rear uprights attached to a rear cross bar; attached to the rear cross bar is at least one releasable fastener that slidably attaches to the at least one slot in the base; the front cradle has attached to it an end stop with at least one nub suitable for engaging the rim of a snare drum, and the rear cradle has a rear end stop; fixably attached to the base is a spur mounting plate and at least one spur is adjustably attached to the mounting plate with at least one spur fastener.

18 Claims, 4 Drawing Sheets

KICK STAND FOR SNARE DRUM

CROSS-REFERENCE TO RELATED APPLICATIONS

This application is an original filing of the invention as a utility patent application.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to a kick stand for a snare drum, and more particularly to a simple, robust, adjustable kick stand.

2. Related Art

There are times when a musician may want to play a snare drum at the same time as he is playing a guitar, or other instrument that requires the use of his hands. To play the snare drum with a kick pedal, using his foot, the snare drum would need to be mounted horizontally on the floor. The present invention provides such a kick stand for a snare drum.

Prior art snare drum stands have typically had a lower support and an upper center post, three or four sets of arms are mounted overhead the center post with 120 to 90 degrees center angle intervals while extending radially outwards. Distant positioning of the radial arms form lugs on the annular brim of a snare drum allows easy mounting of the drum onto the stand and easy tension adjustment via the lugs. Most prior art snare drum stands are not for use with a floor-mounted kick pedal, as they are played upright using drum sticks. There is no prior art snare drum stand that provides for a snare drum to be mounted sideways on or near the floor and used with a kick pedal, that furthermore is simple, robust and adjustable.

Additionally, the present snare drum kick stand also acts as a riser, to elevate the mounted snare drum about 4 inches, which allows the foot pedal beater to strike approximately in the middle of the drum head.

Examples of known snare drum stands are described in the following references, which are hereby incorporated by reference. The references include U.S. Pat. No. 5,467,680, U.S. Pat. No. 6,384,308 and U.S. D295,053.

SUMMARY OF THE INVENTION

The present invention relates to a snare drum kick stand having a base having at least one slot, with a front cradle is supported by front uprights fixably attached to the base, and a rear cradle supported by rear uprights attached to a rear cross bar. Attached to the rear cross bar is at least one releasable fastener that slidably attaches to the at least one slot in the base. The front cradle has attached to it an end stop with at least one nub suitable for engaging the rim of a snare drum, and the rear cradle has a rear end stop. Fixably attached to the base is a spur mounting plate and at least one spur is adjustably attached to the mounting plate with at least one spur fastener.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 3:
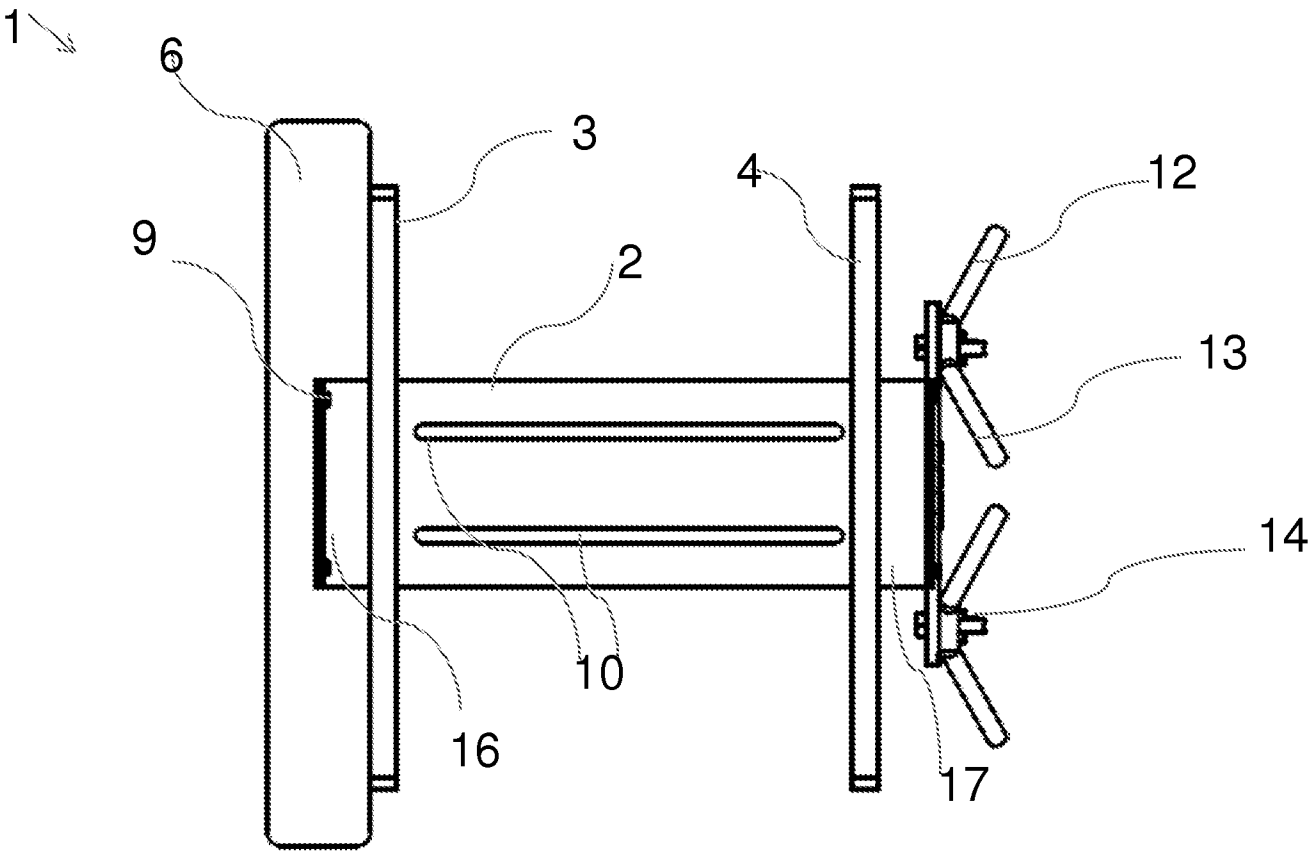
FIG. 3, a top perspective view of the snare drum stand.
Figure 4:
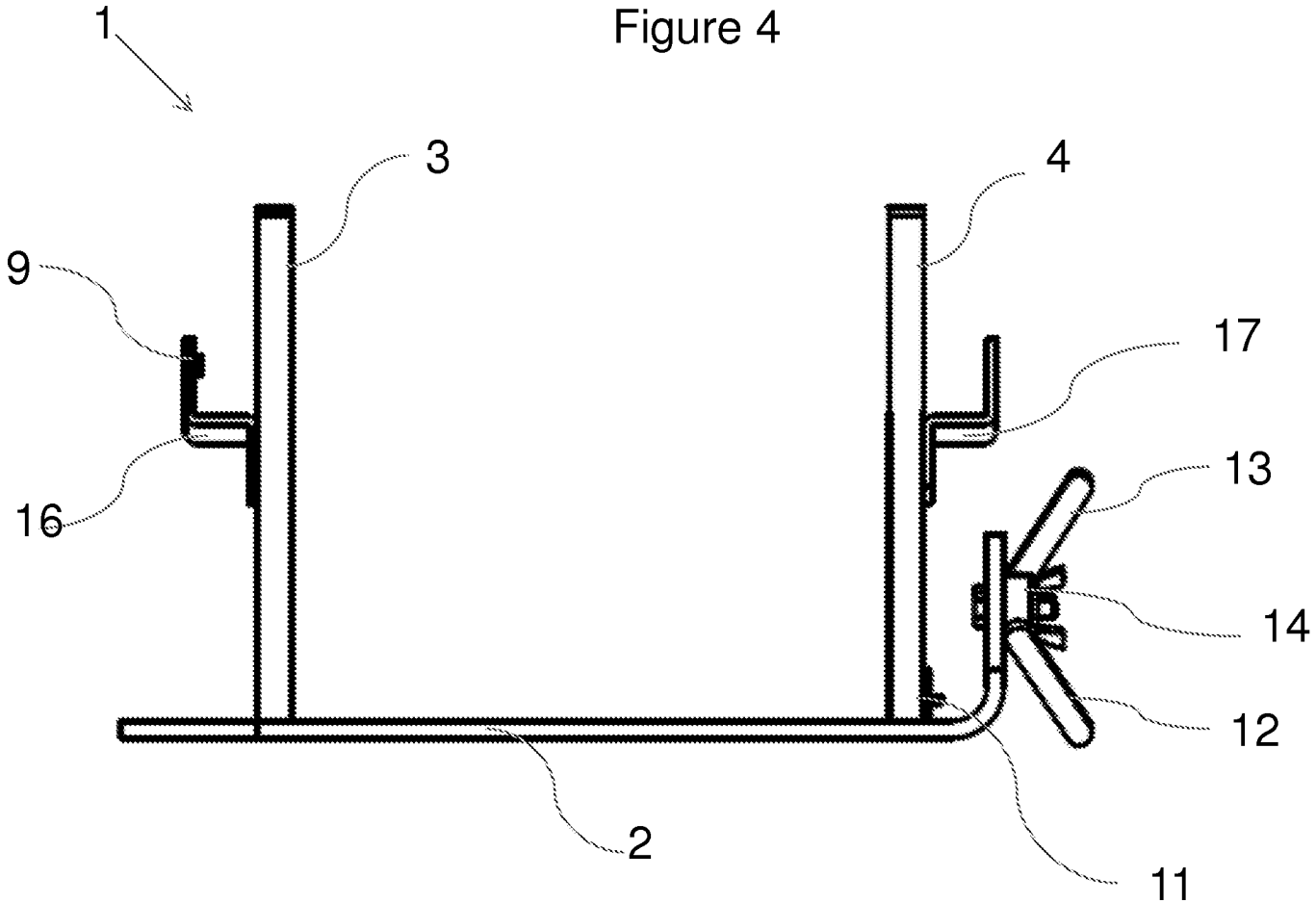
FIG. 4, a side perspective view of the snare drum stand.

The snare drum stand 1 of the present invention is disclosed in the following drawings. As shown in FIG. 3, the base 2 is approximately rectangular and has two slots 10 that are parallel openings along the length of the base. The front lip 6 of the stand is attached to the base 2 and is at about a right angle to the base 2. It is approximately as long as the base. Optionally, the front lip 6 can be an extension of the base 2. Preferably the base is about 12 inches long, and the lip 6 is about 14 inches long. The snare drum stand 1 can be made of any material having sufficient strength to bear the weight of a snare drum without deforming. It can be made of plastic, composite, wood or metal. The preferred material is aluminum.

Figure 1:
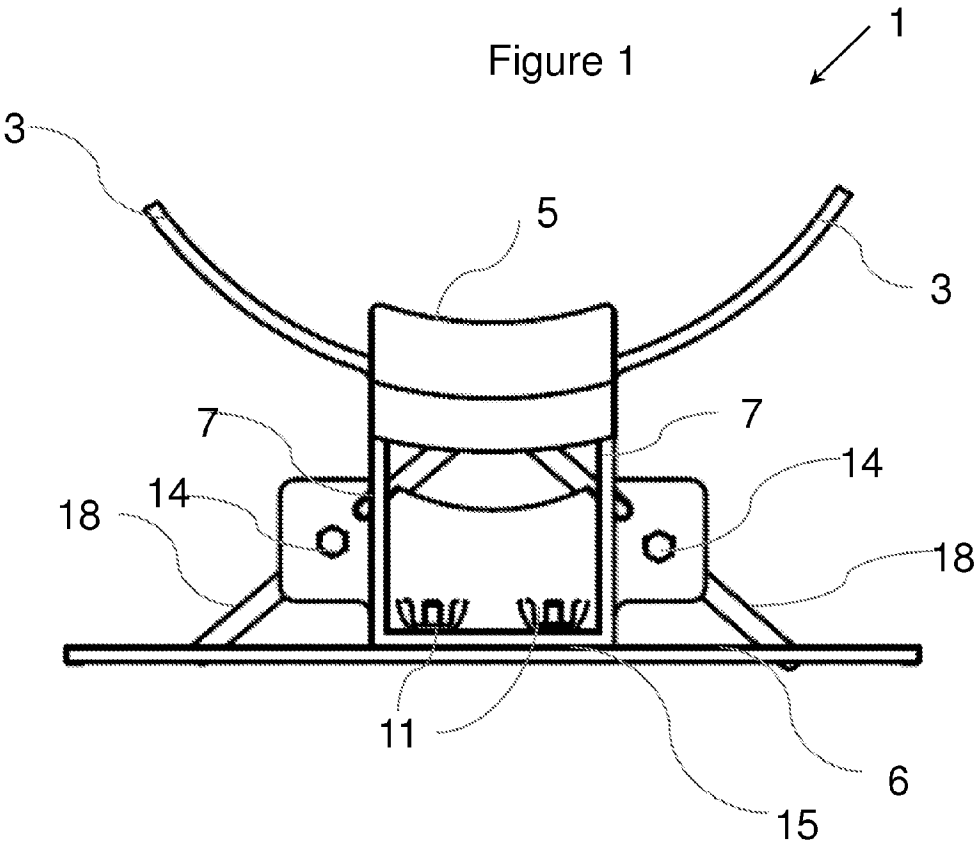
FIG. 1, a front end perspective view of the snare drum stand.
Figure 2:
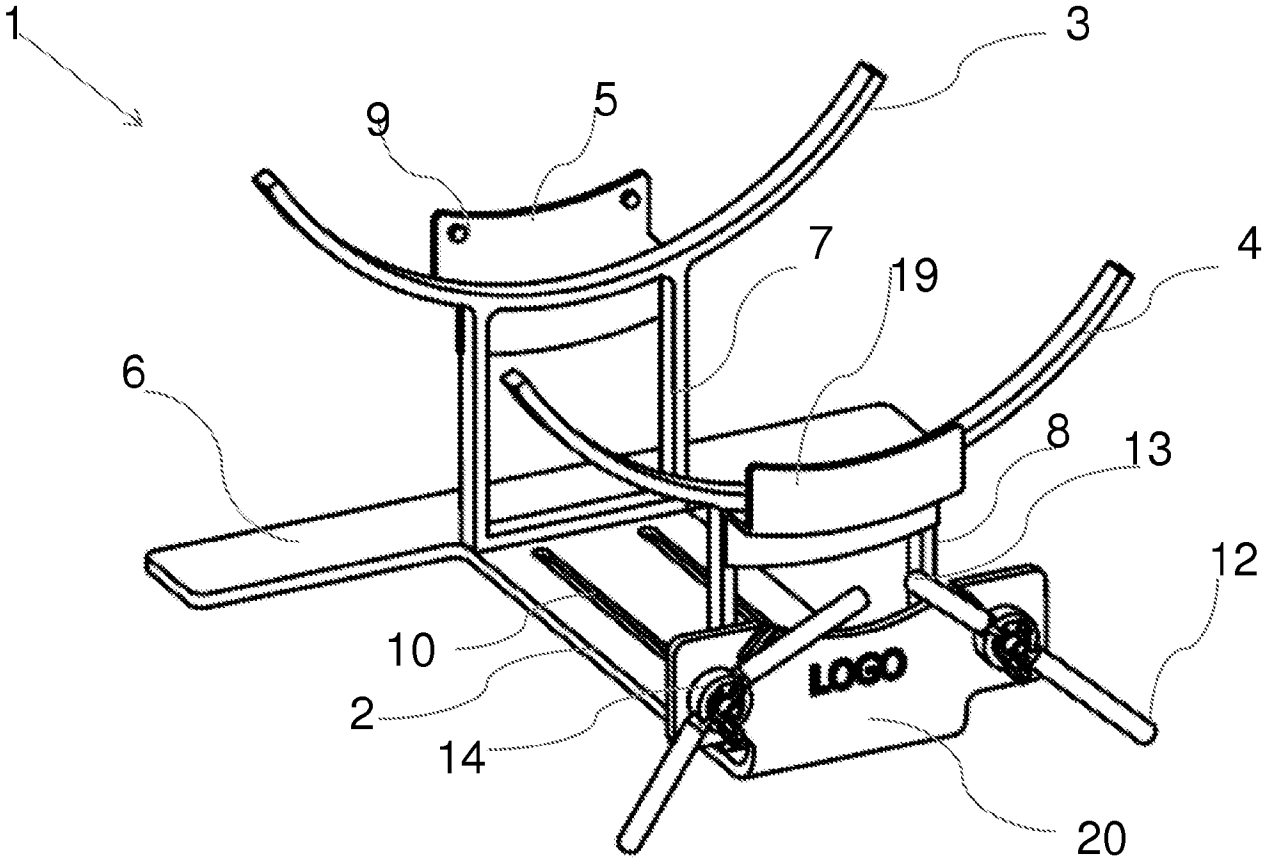
FIG. 2, an elevated perspective view of the snare drum stand.

As shown in FIG. 2, there are two cradles, the front cradle 3 and the rear cradle 4. The cradle 3 is supported by front uprights 7, and the rear cradle 4 is supported by rear uprights 8. The cradles are an arc with a radius of about 7 inches. They are preferably made of ½ inch aluminum. The front uprights 7 support the front end stop 5 which is bent to form the front drum rest 16. The front end stop 5 has two nubs 9 mounted facing the rear end stop 19. The nubs project from the surface of the end stop 5 from about ⅛ to ¼ inches. Likewise, the rear uprights 8 support the rear end stop 19, which is bent to from the rear drum rest 17. The front and rear end stops 5 and 19 are preferably about 4 inches wide. Further the rear uprights 8 are attached at the bottom by rear crossbar 15, which is perpendicular to the uprights and has mounted thereon two slot fasteners 11. The front upright 7 is fixably attached to the base 2, preferably by welding. The rear upright is slidably attached to the slots 10 on the base 2 and is releasably fastened with slot fasteners 11 such as bolts and wing nuts. The snare drum stand 1 is adjustable by moving the rear crossbar 15 of the rear uprights 8 toward or away from the front uprights 7, thereby moving the front cradle 3 and the rear cradle 4 closer or farther apart. The snare drum stand is thereby adjusted to accommodate drums of different sizes, from a 3.5 inch picallo snare to a 10 inch snare drum. When the drum is mounted in the cradles 3 and 4, the nub 9 engages with the rim of the drum (not shown) and secures it.

Attached to the base 2 is a spur mounting plate 20 approximately perpendicular to the base 2. Optionally, the spur mounting plate 20 is an extension of the base 2, wherein the metal base is bent perpendicularly to form the spur mounting plate 20. Attached to the spur mounting plate 20 are two spurs 18. The spurs 18 each have a spur point 12 and a spur stop 13. The spur point 12 is used when the drum stand 1 is on carpet or rugs, and it digs into the carpet and anchors the drum stand 1. When the drum stand 1 is on a smooth surface, such as wood, concrete or vinyl flooring, the stop 13 is used, because it typically has a rubber finish, which grips a smooth surface. The spurs 18 are rotatably mounted on the mounting plate 20 using releasable spur fasteners 14, such as bolts and wing nuts, which are loosened to rotate the spurs 18 and tightened to fix the spurs 18 in the desired position.

To use the drum stand 1, the user places it on the floor or other surface with the cradles 3 and 4 facing upward and the base 2 resting on the surface. The slot fasteners 11 are loosened so that the rear cross bar 15 can be manipulated to allow the drum to be nested into the front cradle 3 and the rear cradle 4. The drum rim catches under the nubs 9 and rests against the front end stop 5. The rear cross bar 15 can be manipulated toward the drum, tightening the end stops 5 and 19 against the rims of the drum, thereby engaging the drum. The slot fasteners 11 are then tightened and the drum is firmly engaged in the kick drum stand 1.

The mounted drum is then adjusted for height using the spurs 18. The spur fasteners 14 are loosened and the selected spur point 12 or spur stop 13 is manipulated into position. The fasteners 14 are then tightened and the snare drum is ready to use. The kick pedal can be inserted under the front lip 6 and latched so that the drum can be played.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A snare drum kick stand comprising a base having at least one longitudinal slot;

wherein a front cradle is supported by front uprights fixably attached to the base;

wherein a rear cradle supported by rear uprights attached to a rear cross bar which is slidably attached to the at least one slot in the base;

wherein the front cradle has attached to it a front end stop, wherein the rear cradle has a rear end stop.

2. The snare drum kick stand of claim 1, wherein fixably attached to the base is a spur mounting plate and at least one spur is adjustably attached to the mounting plate with at least one spur fastener.

3. The snare drum kick stand of claim 2, wherein the at least one spur has a spur point and a spur stop.

4. The snare drum kick stand of claim 1, wherein the front end stop has at least one nub.

5. The snare drum kick stand of claim 1, wherein attached to the base is a front lip.

6. The snare drum kick stand of claim 1, wherein bent into the front and rear end stops are front and rear drum rests, respectively.

7. A snare drum kick stand comprising a base having two longitudinal slots;

wherein a front cradle is supported by two front uprights fixably attached to the base;

wherein a rear cradle supported by two rear uprights attached to a rear cross bar which is slidably attached to the at least one slot in the base;

wherein the front cradle has attached to it a front end stop;

wherein the rear cradle has a rear end stop;

wherein attached to the base is a front lip;

wherein bent into the front and rear end stops are front and rear drum rests, respectively;

wherein fixably attached to the base is a spur mounting plate and two spurs are adjustably attached to the mounting plate with at least two spur fasteners; and wherein the two spurs each have a spur point and a spur stop.

8. The snare drum kick stand of claim 7, wherein the front end stop has two nubs.

9. The snare drum kick stand of claim 8, wherein the spur stop has a rubber cover.

10. The snare drum kick stand of claim 9, wherein the stand is made of metal.

11. The snare drum kick stand of claim 10, wherein the metal is aluminum.

12. A method of mounting a snare drum having at least one rim for use with a kick petal comprising:

placing a snare drum kick stand comprising a base having at least one longitudinal slot having slot fasteners;

wherein a front cradle is supported by front uprights fixably attached to the base;

wherein a rear cradle supported by rear uprights attached to a rear cross bar which is slidably attached to the at least one slot in the base;

wherein the front cradle has attached to it a front end stop with at least one nub;

wherein the rear cradle has a rear end stop on a floor or flat surface with the cradles facing upward and the base resting on the surface;

wherein attached to the base is a front lip;

wherein bent into the front and rear end stops are front and rear drum rests, respectively;

comprising the steps:

a) loosen the slot fasteners loosened so that the rear cross bar can be manipulated to allow the drum to be nested into the front cradle and the rear cradle;

b) catch the drum rim under the at least one nub and rest the drum against the front end stop;

c) manipulate the rear cross bar toward the drum;

d) push the end stops against the rims of the drum, thereby engaging the drum; and e) tighten the slot fasteners and so that the drum is firmly mounted in front and rear drum rests of the kick drum stand.

13. The method of claim 12, wherein fixably attached to the base is a spur mounting plate and two spurs are adjustably attached to the mounting plate with at least two spur fasteners wherein the two spurs each have a spur point and a spur stop wherein the spur fasteners are loosened and the selected spur point or spur stop is manipulated into position;

wherein the mounted drum is adjusted for height using the spurs; and wherein the fasteners are tightened and the snare drum is ready to use.

14. The method of claim 13, wherein a kick pedal can be inserted under the front lip and latched so that the drum can be played.

15. The method of claim 12, wherein the front end stop has two nubs.

16. The method of claim 12, wherein the spur stop has a rubber cover.

17. The method of claim 12, wherein the stand is made of metal.

18. The method of claim 17, wherein the metal is aluminum.

* * * * *